US006007085A

United States Patent [19]

Rigal et al.

[11] Patent Number: 6,007,085

[45] Date of Patent: Dec. 28, 1999

[54] DEVICE FOR RETAINING A BOOT ON A GLIDING BOARD

[75] Inventors: Jean-Pierre Rigal, La Balme de Sillingy; Bernard Couderc, Annecy, both of France

[73] Assignee: Salomon S. A., Metz-Tessy, France

[21] Appl. No.: 08/907,614

[22] Filed: Aug. 8, 1997

[30] Foreign Application Priority Data

Aug. 9, 1996 [FR] France ..... 96 10183

[51] Int. Cl.[6] ..... A63C 5/03

[52] U.S. Cl. ..... 280/607; 280/618; 280/14.2

[58] Field of Search ..... 280/607, 617, 280/618, 616, 14.2, 623, 626, 628, 629, 630

[56] References Cited

U.S. PATENT DOCUMENTS 5,236,516 8/1993 Ratzek ..... 280/607
5,261,689 11/1993 Carpenter et al. ..... 280/618
5,417,443 5/1995 Blattner et al. ..... 280/14.2

FOREIGN PATENT DOCUMENTS 0351298 1/1990 European Pat. Off. .
2621254 4/1989 France .
678397 9/1991 Switzerland .
WO93/14835 8/1993 WIPO .

*Primary Examiner*—Richard M. Camby
*Attorney, Agent, or Firm*—Greenblum & Bernstein, P.L.C.

[57] ABSTRACT

A device for retaining a boot on a gliding board, the device including a base for receiving the boot, at least one tightening arrangement to bias the base toward the board. The device according to the invention includes at least one mechanism for positioning the base with respect to the board both translationally in any direction substantially parallel to the board, and rotationally along any angle with respect to an axis substantially perpendicular to the board.

20 Claims, 4 Drawing Sheets

DEVICE FOR RETAINING A BOOT ON A GLIDING BOARD

BACKGROUND OF THE INVENTION

1. Field of the Invention

The present invention relates to the field of devices for retaining a boot on a gliding board adapted for snowboarding, and relates more particularly to the positioning of the devices on the board.

2. Background and Material Information

Snowboarding is undertaken with needs that vary from one user to the next, especially with respect to the feet position on the board.

It is necessary for the user to be able to adjust the position of each boot retaining device, so as to steer the board precisely and under proper safety conditions.

The prior art has proposed devices for retaining a boot on a board.

For example, the U.S. Pat. No. 5,236,216 describes a device including a plate that is tightened on a board by means of a disc and screws. Each screw cooperates with an insert affixed to the board, such that the tightening of the screws biases the disc toward the plate which, in turn, is immobilized by friction upon contact with the board. This device enables a rotational adjustment of a boot affixed to the plate because the plate is rotationally guided by the disc. This device also enables an adjustment in a translational direction of the boot, by means of oblong holes in the disc.

However, the device according to the U.S. Pat. No. 5,236,216 has disadvantages. Initially, the device enables translational adjustments in a single direction substantially parallel to the board, which prevents the user from adapting the positions of the boots along both the length and the width of the board.

Furthermore, the large number of disc retaining screws renders the adjustment quite time-consuming and tedious.

Moreover, the inserts which receive the disc retaining screws are worn quite quickly because they are biased with every adjustment. When they are worn, the inserts no longer make it possible to affix the device. As a result, the board is unusable.

SUMMARY OF THE INVENTION

The object of the invention is to remedy these drawbacks.

To this end, the invention proposes a device for retaining a boot on a gliding board, the device including a base for receiving the boot, at least one tightening means biasing the base toward the board.

The device according to the invention includes at least one means for positioning the base with respect to the board both translationally along any direction substantially parallel to the board, and rotationally along any angle with respect to an axis substantially perpendicular to the board.

This structure enables the user to adapt the positions of the boots along both the length and the width of the board.

According to an embodiment, the device according to the invention includes a plate that is inserted between the board and the base, at least one tightening means maintaining the base on the plate, other tightening means maintaining the plate on the board, it includes means for positioning the plate on the board in translation along two directions substantially parallel to the board, on the one hand, and means for positioning the base with respect to the plate both translationally in any direction substantially parallel to the board, and rotationally along any angle with respect to an axis substantially perpendicular to the board, on the other hand.

This structure makes it possible to undertake a prepositioning of the device on the board by positioning the plate in a preferred area of the board. Then, the user can adjust the wedging of the device by changing the position of the base on the plate. It follows that the adjustments of the position of the device essentially use the plate. Since the plate is an intermediate part, it is advantageously possible to replace it when it is worn, without it being necessary to replace the board.

In addition, according to the invention, the means for positioning the plate on the board include at least two sets of openings defined in the plate for passage of the screws, and a set of threaded openings defined in the board to receive the screws, the openings of each set being similarly arranged with respect to one another.

In this way, it is advantageously possible to position the plate on the board along at least two distinct directions.

Preferably, each set of openings includes four openings located in the four angles, respectively, of a square. As a result, the mounting of the plate on the board is simple.

Still preferably, the plate includes five sets of openings which are arranged with respect to one another so as to form four identical groups of five openings, each of the five openings of a group being a part of a different set of openings.

This arrangement makes it possible to undertake a preadjustment of the position of the device on the board.

For each group of openings, four openings are located in the four corners of a square, and one opening is located in the center of the square. Therefore, the preadjustment of the position of the device on the board is carried out along two perpendicular directions which can correspond to the length and to the width of the board.

Finally, the openings of a same set are located on the sides of a square, at 40 mm from one another, and the openings of each group are, two by two, 10 mm apart along the diagonals of the square.

In this way, the device according to the invention adapts to the commercially available standard boards, and enables a prepositioning of ten millimeters, more or less, in two directions with respect to a reference point on the board.

Further, according to the invention, the means for positioning the base on the plate include a shoulder projecting from the plate, the shoulder being housed in an opening of the base, the opening being larger than the shoulder.

This structure makes it possible to position the base with respect to the plate both translationally and rotationally, in any direction.

Preferably, the opening of the base has the shape of a square with rounded angles. A screw tightened in the plate extends through the opening of the base through a threaded portion and takes support on the base through a head, to maintain the base on the plate. Since the base is tightened on the plate by a single screw, the adjustment operations are quick and easy.

Finally, the coefficient of friction between the washer and the base is preferably less than the coefficient of friction between the base and the plate. This arrangement enables a stronger tightening of the base on the plate.

The invention also relates to a board including the device.

BRIEF DESCRIPTION OF DRAWINGS

Other characteristics and advantages of the invention will be better understood along the description that follows, with reference to the annexed drawings illustrating, by way of a non-limiting example, how the invention can be embodied, and in which.

DETAILED DESCRIPTION OF THE PREFERRED EMBODIMENTS

Figure 1:
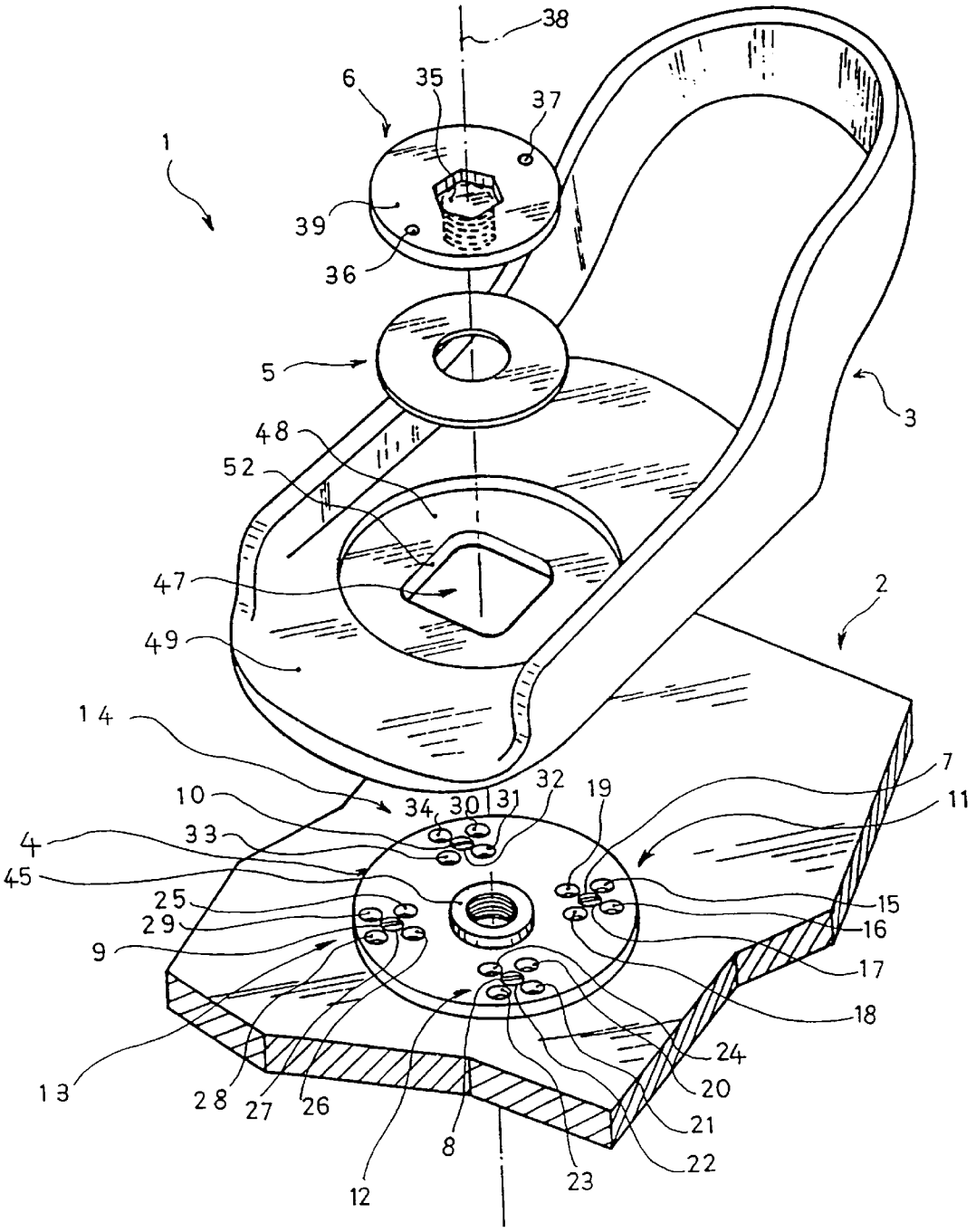
FIG. 1 is an exploded perspective view of a device according to the invention.

A device 1 for retaining a boot on a guiding board 2 is shown in an exploded perspective view in FIG. 1. The device 1 includes a base 3 adapted to receive the boot, not shown, of a user, the base 3 being maintained on the board 2 by means of a plate 4, of a washer 5 and of a screw 6.

The plate 4 is affixed to the board 2 by affixation means provided in the form of four screws 7, 8, 9, 10, extending through openings of the plate 4 to get housed in threaded inserts, not shown, of the board 2.

The openings of the plate 4 are divided into four groups 11, 12, 13, 14, each group 11, 12, 13, 14, including five openings.

For example, the group 11 includes five cylindrical openings 15, 16, 17, 18, 19, arranged as follows: the axes of the openings 15, 16, 18, and 19 demarcate the four corners of a square whose diagonal is 20 millimeters, the opening 17 being positioned in the center of the square. In this way, the central opening 17 of the group 11 is located 10 mm from each of the other openings 15, 16, 18 and 19.

Similarly, the group 12 includes five cylindrical openings 20, 21, 22, 23, 23, the opening 22 being central; the group 13 includes five cylindrical openings 25, 26, 27, 28, 29, the opening 27 being central; and the group 14 includes five cylindrical openings 30, 31, 32, 33, 34, the opening 32 being central.

Each central opening 17, 22, 27, and 32 of the groups 11, 12, 13, 14, is arranged in the four angles of a square whose side is 40 millimeters to form a first set of openings.

In FIG. 1, the screws 7, 8, 9, 10, pass through the central openings 17, 22, 27, 32 of the groups 11, 12, 13, 14, respectively.

The groups 11, 12, 13, and 14 are oriented on the plate 4 so as to be capable of displacing the plate 4 with respect to the board 2 10 mm, more or less, along a first direction, and 10 mm, more or less, along a second direction substantially perpendicular to the first. This is why the openings are aligned by six. For example, the openings 15, 17, 18 of the group 11 are aligned with the openings 20, 22, 23, of the group 12.

Likewise, the openings 30, 32, 33, of the group 14 are aligned with the openings 25, 27, 28 of the group 13. The openings 29, 27, 26 of the group 13 are aligned with the openings 24, 22, 21, of the group 12.

Finally, the openings 34, 32, 31 of the group 14 are aligned with the openings 19, 17, 16 of the group 11.

Therefore, the plate 4 can be displaced with respect to the board 2 in four different ways with respect to that shown in FIG. 1. It suffices to remove the four screws 7, 8, 9, 10, arranged in the first set of openings and place them in one of the four other sets which are successive as follows: one set including the openings 18, 23, 28 and 33 taken in the groups 11, 12, 13, 14, respectively, one set including the openings 19, 24, 29, 34, one set including the openings 15, 20, 25, 30, or one set including the openings 16, 21, 26, 31. Then, it suffices to tighten the screws 7, 8, 9, 10, in the threaded inserts of the board 2 so that the plate 4 is found in a preadjustment positions on the board 2.

Figure 2:
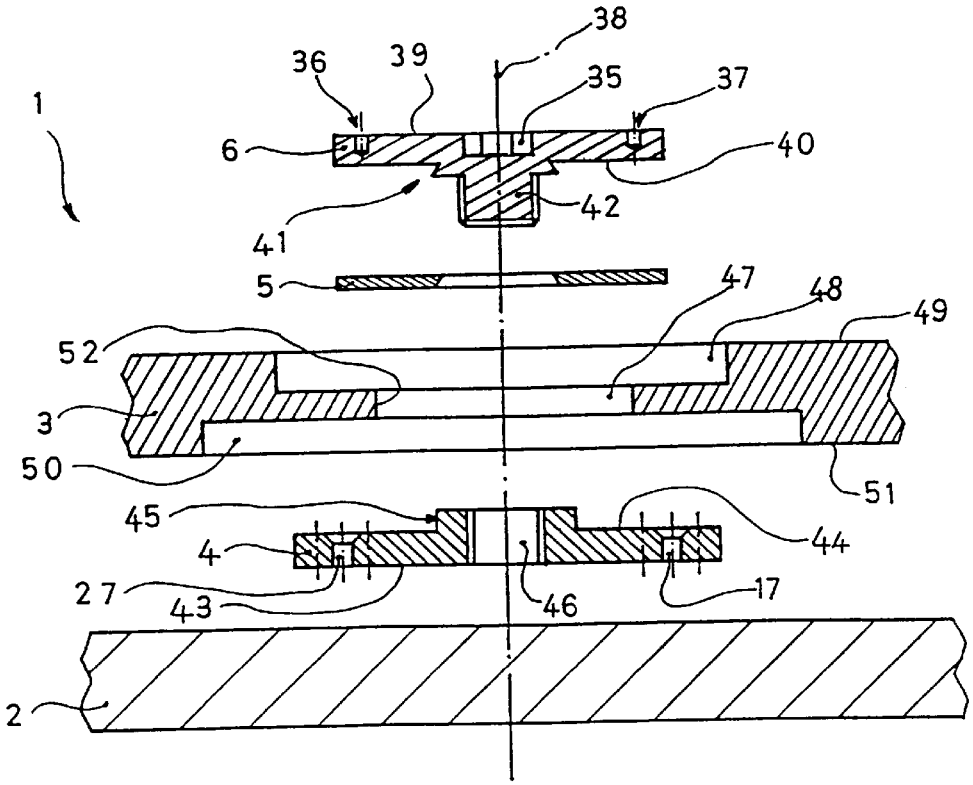
FIG. 2 is a partial cross section of FIG. 1.
Figure 3:
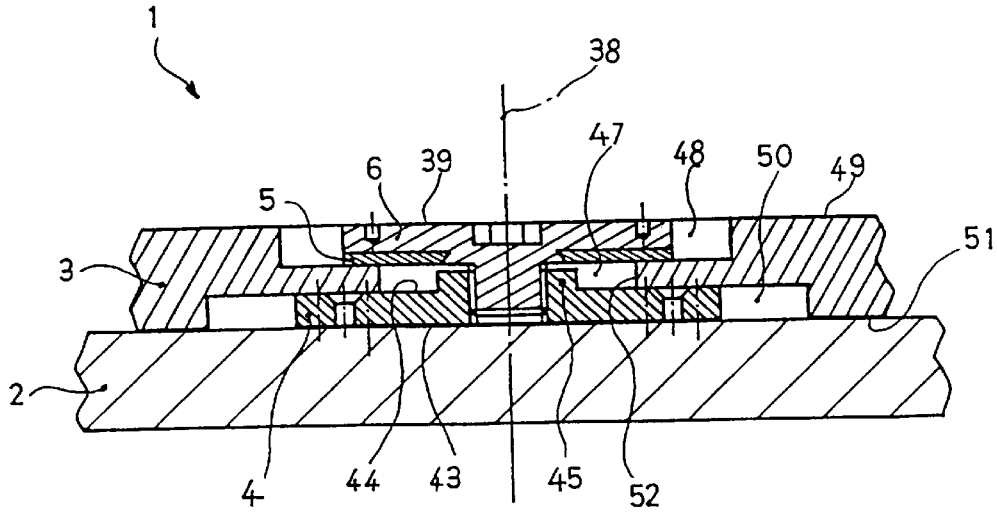
FIG. 3 is a partial cross section of the device in a position of use.

Complimentarily, the position of the base 3 is provided to be adjusted with respect to the plate 4, as explained by means of FIGS. 2 and 3.

FIG. 2 is a partial cross section of FIG. 1 passing through the openings 27 and 17 of the plate 4 in a plane substantially perpendicular to the board 2.

The screw 6, washer 5, base 3, plate 4 and board 2 are found in FIG. 2. The screw 6 can be tightened or loosened with various tools cooperating with means for connecting the screw 6 to the tools.

For example, the tool can be a hexagonal wrench cooperating a hexagonal cavity 35 of the screw, or a pin wrench cooperating with two screw openings 36,37, diametrically opposed with respect to an axis of rotation 38 of the screw 6. The cavity 35 and the openings 36,37, are defined on a surface 39 of the screw which faces the boot, not shown, of the user.

A surface 40 of the screw 6, opposite the surface 39, has a circular groove 41 for retaining the washer 5 against the surface 40, as well as a threaded central shoulder 42 provided to cooperate with the plate 4. The thickness of the material comprised between the surfaces 39 and 40 of the screw 6 demarcates the head of the screw 6.

The plate 4 is a revolving part having, in addition to the previously described openings for positioning on the board 2, a surface 43 on the side of the board 2, a surface 44 opposite the surface 43, a shoulder 45 projecting on the surface 44, and a central threaded opening 46 extending through the plate 4 and the shoulder 45. The opening 46 and the shoulder 45 have a common axis which merges with the axis 38 of the screw 6 when the device 1 is assembled.

The base 3 is obtained so as to cooperate with the plate 4 and the screw 6. To this end, it is traversed by an opening 47 whose diameter is greater than the diameter of the shoulder 45 of the plate 4. A countersink 48 is provided in a surface 49 of the base 3 located on the side of the screw 6 to receive the washer 5 and the head of the screw 6. A countersink 50 is provided in a surface 51 of the base 3 located on the side of the board 2 to receive the plate 4. The countersink 48, the opening 47 and the countersink 50 are coaxial.

The device 1 is shown in cross section in an adjusted position in FIG. 3.

The screw 6 is tightened in the plate 4 which, in turn, is immobilized on the board 2. The screw 6 biases the base 3 toward the board 2 and the plate 4 via the washer 5 inserted between the head of the screw 6 and the bottom of the countersink 48 of the base 3. As a result, the base is immobilized with respect to the board 2 by friction on the board 2 and/or on the face 44 of the plate 4.

For convenience, the screws and inserts of the board 2 which make it possible to affix the plate 4 to the board 2 are not shown.

The diameter of the countersink 48 is greater than that of the head of the screw 6, and the diameter of the countersink 50 is greater than that of the plate 4. This is why the base 3 is movable with respect to the board 2 when the screw 6 is loosened. Preferably, the respective diameters of the countersink 48, of the opening 47, and of the countersink 50 of the base 3 are provided, such that the displacement of the base 3 with respect to the plate 4 is limited by the contact of a wall 52 of the opening 47 of the base 3 on the shoulder 45 of the plate 4.

It is thus possible, when the screw 6 is loosened, to displace the base 3 in a plane substantially parallel to the board 2 along a limited movement. It is also possible to orient the base 3 in rotation along any angle with respect to an axis that is substantially perpendicular to the board 2.

To summarize, the structure of the device 1 enables an infrequent preadjustment and more frequent complementary adjustments of the position of the boot with respect to the board 2.

Figure 4:
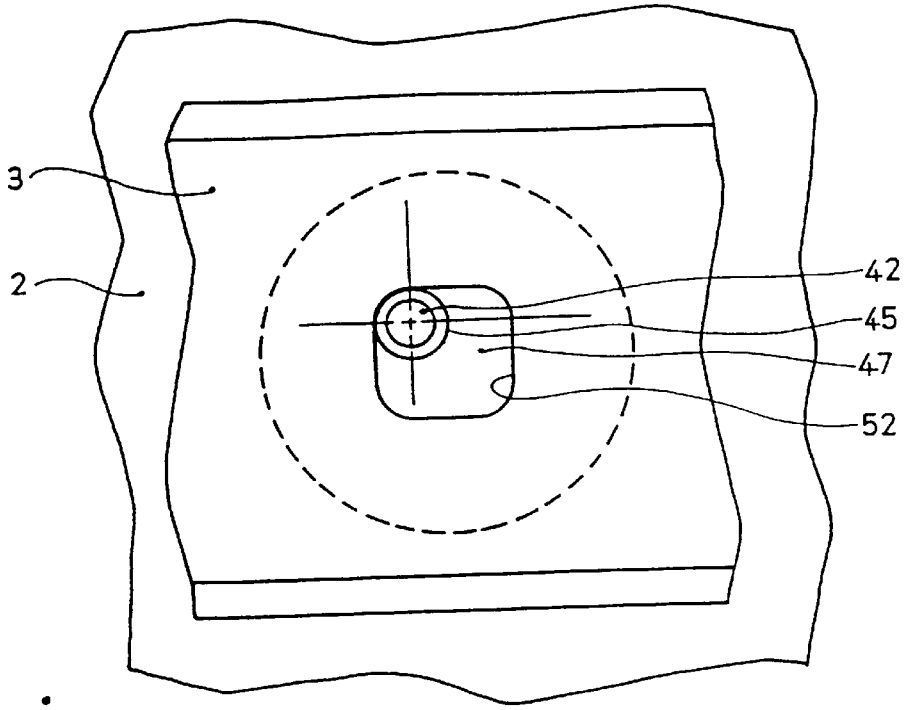
FIG. 4 is a sketch which provides an example of orientation of the device.
Figure 5:
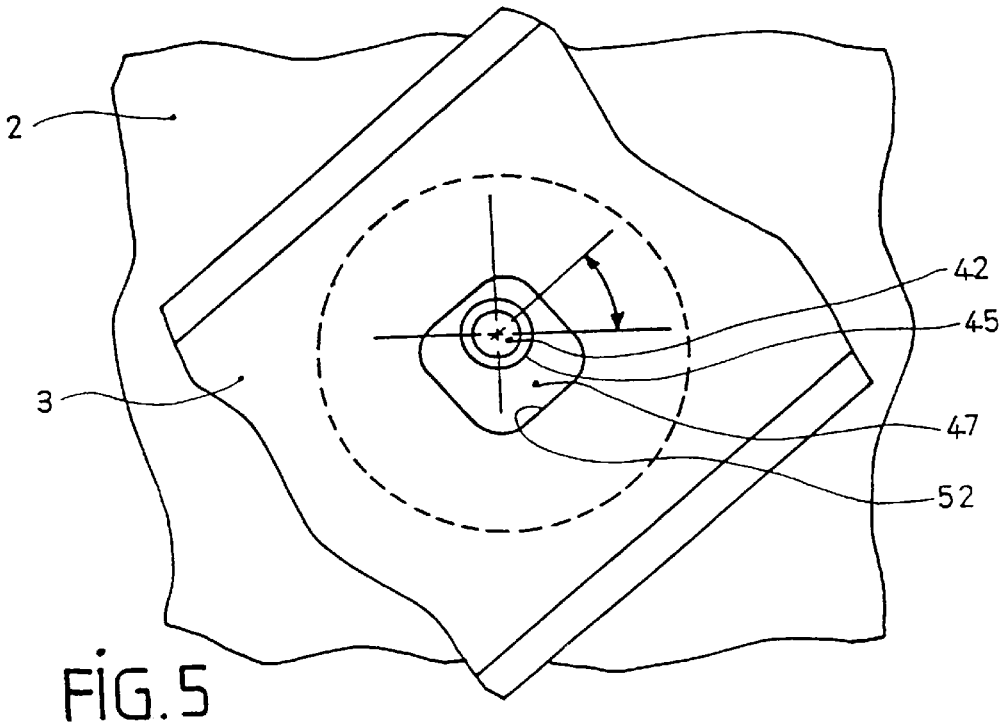
FIG. 5 is similar to FIG. 4 and corresponds to another orientation of the device.

FIGS. 4 and 5 schematically show two examples of orientation of the base 3 of the device 1. Each example corresponds to a frozen position of the board 2 and to a given position preadjustment of the plate 4.

FIG. 4 shows the base 3 positioned such that the shoulder 45 of the plate 4 is in contact with the wall 52 of the opening 47 of the base 3. When the screw 6, not visible in FIG. 4, is tightened, the base 3 remains in this position.

If the screw 6 is loosened, one can displace the base 3 and place it in any other position, such as that shown in FIG. 5.

In this case, the shoulder 45 of the plate 4 is not in contact with the wall 52 of the opening 47 of the base 3. The positioning of the base 3 according to FIG. 5 differs from its positioning according to FIG. 4, both translationally parallel to the board 2 and rotationally along an axis perpendicular to the board 2.

The device 1 can be made of all of the materials known to the one with ordinary skills in the art, using any appropriate technique. Preferably, the plate 4 and the screw 6 are made of metals or metal alloys, such as steel alloys. The washer 5 is made out a material having a low coefficient of friction, such as a bronze alloy, an aluminum washer whose surface is chemically treated to include anti-adhesion products, a reinforced or non-reinforced plastic material, such a polytetrafluoroethylene.

The base 3 is preferably made of an injected plastic material. One can provide to add layers of materials or to mechanically or chemically treat parts of the device 1 so as to control the rubbing conditions of the parts on one another.

Figure 6:
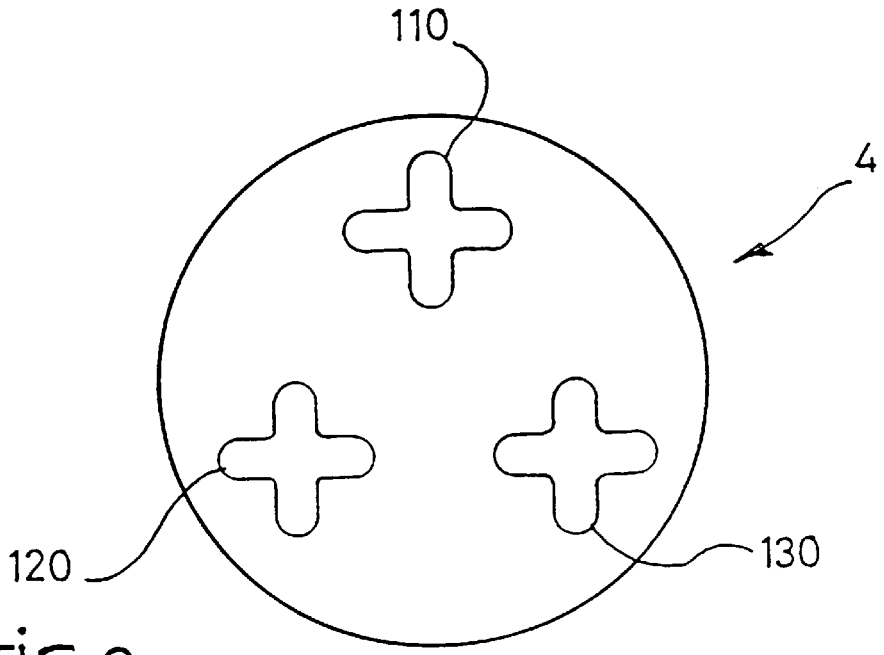
FIG. 6 is an elevated view of the plate according to an alternative embodiment.

As shown in FIG. 6, the plate 4 can have slots 110, 120, 130, to replace the groups of openings, in order to facilitate the adjustment along two perpendicular directions, without it being necessary to undertake the operations of completely loosening/retightening the screws. The number of slots can vary. For a proper maintenance of the plate on the board, at least two slots are necessary. In the example of FIG. 5, three slots 110, 120, 130, are provided in the form of a cross and arranged in a triangle through the plate.

Figure 7:
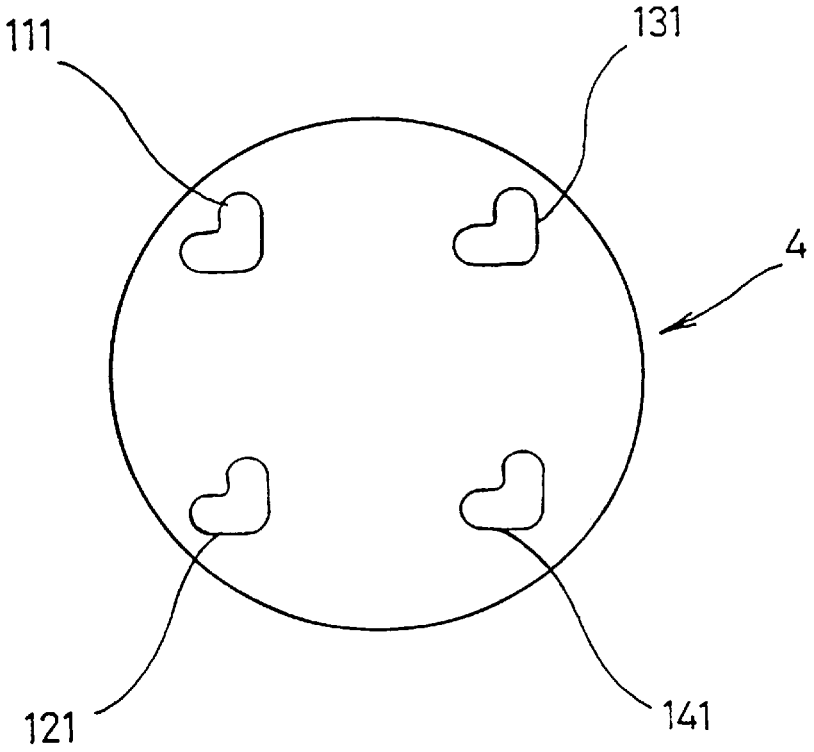
FIG. 7 is an elevated view of the plate according to another alternative embodiment.

FIG. 7 shows another variation in which four L-shaped slots 111, 121, 131, 141, are provided to enable a continuous adjustment in three distinct portions of the plate on the board on each series of openings of the board.

Of course, the invention is not limited to the embodiment thus described, and includes all technical equivalents that fall within the scope of the claims that follow.

In particular, various dimensional values for the parts of the device 1 can be provided to adapt the functioning ranges.

The shape of the opening 47 of the base 3 can be circular, elliptical or else.

Any known element for retaining a boot on a base can be used, and the base can have a different form than that shown in FIG. 1.

One can also provide to insert a layer for raising the device 1 between the board 2 and the device 1.

The instant application is based upon French Priority Patent Application No. 96 10183, filed on Aug. 9, 1996, the disclosure of which is hereby expressly incorporated by reference thereto, and the priority of which is hereby claimed under 35 U.S.C. §119.

What is claimed:

1. A device for retaining a boot on a gliding board, the device comprising:

a base having a structural configuration shaped to receive the boot;

a plate to be fixedly secured to the gliding board, said base being positioned on said plate, said base having a lower surface adapted to be supported on the gliding board during use of the gliding board;

an affixing system to fix said plate on the gliding board and to adjust a position of said plate with respect to the gliding board in translation along two directions substantially parallel to the gliding board;

a tightening system to tighten said base on said plate in a determinate position and to position said base with respect to said plate both in translation in any direction substantially parallel to the gliding board, and in rotation along any angle with respect to an axis substantially perpendicular to the gliding board;

wherein said affixing system includes at least two sets of openings in said plate for screws adapted to cooperate with a set of threaded openings made in the gliding board; and wherein said tightening system includes a shoulder projecting upwardly from said plate and a through opening in said base, said through opening being larger than said shoulder and said shoulder being housed within said through opening.

2. A retention device according to claim 1, wherein:

each set of said openings in said plate of said affixing system comprises four openings located at four corners of a square, respectively.

3. A retention device according to claim 1, wherein:

said sets of said openings in said plate of said affixing system comprises groups of five openings.

4. A retention device according to claim 2, wherein:

said sets of said openings in said plate of said affixing system comprises groups of five openings.

5. A retention device according to claim 3, wherein:

each set of said openings is arranged with respect to one another so as to form four identical groups of five openings, each of said five openings of one of said groups being a part of a different respective set of openings.

6. A retention device according to claim 5, wherein:

for each of said groups, four openings of said five openings are located at four respective corners of a square and one opening of said five openings is located at a center of said square.

7. A retention device according to claim 2, wherein:

for each of said sets of openings, respective pairs of openings of a set define a side of said square having a length of 40 millimeters; and said openings within each group are spaced apart 10 millimeters along the diagonals of the square.

8. A retention device according to claim 1, wherein:

said through opening of said base has the form of a square with rounded corners.

9. A retention device according to claim 1, wherein:

said tightening system includes a screw having a threaded portion extending through said through opening of said base and a head supported on said base to maintain said base on said plate.

10. A retention device according to claim 9, wherein:

said tightening system further comprises a washer positioned between said head of said screw and said base.

11. A retention device according to claim 10, wherein:

a coefficient of friction between said washer and said base is less than a coefficient of friction between said base and said plate.

12. An assembly comprising:

a gliding board; and a device for retaining a boot on said gliding board, said device comprising:

a base having a structural configuration shaped to receive the boot;

a plate to be fixedly secured to the gliding board, said base being positioned on said plate, said base having a lower surface adapted to be supported on the gliding board during use of the gliding board;

an affixing system to fix said plate on the gliding board and to adjust a position of said plate with respect to the gliding board in translation along two directions substantially parallel to the gliding board;

a tightening system to tighten said base on said plate in a determinate position and to position said base with respect to said plate both in translation in any direction substantially parallel to the gliding board, and in rotation along any angle with respect to an axis substantially perpendicular to the gliding board;

wherein said affixing system includes at least two sets of openings in said plate for screws adapted to cooperate with a set of threaded openings made in the gliding board; and wherein said tightening system includes a shoulder projecting upwardly from said plate and a through opening in said base, said through opening being larger than said shoulder and said shoulder being housed within said through opening.

13. A device for retaining a boot on a gliding board, the device comprising:

a base having a structural configuration shaped to receive the boot;

a plate to be fixedly secured to the gliding board, said base being positioned on said plate, said base having a lower surface adapted to be supported on the gliding board during use of the gliding board;

an affixing system to fix said plate on the gliding board and to adjust a position of said plate with respect to the gliding board in translation along two directions substantially parallel to the gliding board;

a tightening system to tighten said base on said plate in a determinate position and to position said base with respect to said plate both in translation in any direction substantially parallel to the gliding board, and in rotation along any angle with respect to an axis substantially perpendicular to the gliding board;

wherein said affixing system includes at least two elongated slots adapted to cooperate with a set of threaded openings made in the gliding board to enable adjustment of said plate on the gliding board in two substantially perpendicular directions; and wherein said tightening system includes a shoulder projecting upwardly from said plate and a through opening in said base, said through opening being larger than said shoulder and said shoulder being housed within said through opening.

14. A retention device according to claim 13, wherein:

each of said elongated slots is cross-shaped.

15. A retention device according to claim 13, wherein:

each of said elongated slots is L-shaped.

16. A retention device according to claim 17, wherein:

said through opening of said base has the form of a square with rounded corners.

17. A retention device according to claim 13, wherein:

said tightening system includes a screw having a threaded portion extending through said through opening of said base and a head supported on said base to maintain said base on said plate.

18. A retention device according to claim 17, wherein:

said tightening system further comprises a washer positioned between said head of said screw and said base.

19. A retention device according to claim 18, wherein:

a coefficient of friction between said washer and said base is less than a coefficient of friction between said base and said plate.

20. An assembly comprising:

a gliding board; and a device for retaining a boot on said gliding board, said device comprising:

a base having a structural configuration shaped to receive the boot;

a plate to be fixedly secured to the gliding board, said base being positioned on said plate, said base having a lower surface adapted to be supported on the gliding board during use of the gliding board;

an affixing system to fix said plate on the gliding board and to adjust a position of said plate with respect to the gliding board in translation along two directions substantially parallel to the gliding board;

a tightening system to tighten said base on said plate in a determinate position and to position said base with respect to said plate both in translation in any direction substantially parallel to the gliding board, and in rotation along any angle with respect to an axis substantially perpendicular to the gliding board;

wherein said affixing system includes at least two elongated slots adapted to cooperate with a set of threaded openings made in the gliding board to enable adjustment of said plate on the gliding board in two substantially perpendicular directions; and wherein said tightening system includes a shoulder projecting upwardly from said plate and a through opening in said base, said through opening being larger than said shoulder and said shoulder being housed within said through opening.

* * * * *